US007036407B2

(12) United States Patent
Pyre et al.

(10) Patent No.: US 7,036,407 B2
(45) Date of Patent: May 2, 2006

(54) WRENCH WITH CONTROLLED TIGHTENING

(75) Inventors: Alain Pyre, Saint Just (FR); Gilles Frechon, Val David (FR); Pascal Coudrier, Bueil (FR); Ange-Marie Guillemin, Vernon (FR); Christian Roure, Vernon (FR)

(73) Assignee: Snecma Moteurs, Paris (FR)

( * ) Notice: Subject to any disclaimer, the term of this patent is extended or adjusted under 35 U.S.C. 154(b) by 116 days.

(21) Appl. No.: 10/806,003

(22) Filed: Mar. 22, 2004

(65) Prior Publication Data

US 2004/0187652 A1 Sep. 30, 2004

(30) Foreign Application Priority Data

Mar. 26, 2003 (FR) ..... 03 03695

(51) Int. Cl.
*B24B 23/14* (2006.01)

(52) U.S. Cl. ..... 81/467; 81/429; 73/862.23

(58) Field of Classification Search ..... 81/429, 81/467, 478, 479, 483; 73/862.21, 862.22, 73/862.23, 862.24, 141, 139
See application file for complete search history.

(56) References Cited

U.S. PATENT DOCUMENTS 4,333,220 A * 6/1982 Aspers ..... 29/407.02
4,375,121 A 3/1983 Sigmund
4,858,312 A * 8/1989 Van Naarden ..... 29/861
5,154,242 A * 10/1992 Soshin et al. ..... 173/178
6,167,788 B1 * 1/2001 Schonberger et al. ..... 81/467
6,276,243 B1 * 8/2001 Jenkins ..... 81/479

FOREIGN PATENT DOCUMENTS

| | | | |
|---|---|---|---|
| DE | 33 27 964 | A | 2/1985 |
| DE | 44 04 419 | A | 8/1995 |
| EP | 1 022 097 | A | 7/2000 |
| FR | 2 780 785 | A | 1/2000 |
| WO | WO 98 22263 | A | 5/1998 |
| WO | WO 00 64639 | A | 11/2000 |

* cited by examiner

*Primary Examiner*—Lee D. Wilson
*Assistant Examiner*—Anthony Ojini
(74) *Attorney, Agent, or Firm*—Weingarten, Schurgin, Gagnebin & Lebovici LLP

(57) ABSTRACT

The invention provides an electronic wrench which includes means for measuring the instantaneous applied torque and means for measuring the instantaneous angle of rotation during tightening. The physical parameters of the screw connection for tightening and a setpoint value for the tightening are initially entered into the wrench via a keypad. During the tightening operation, the processor means calculate the instantaneous traction force on the screw fastener as a function of the measured instantaneous values of torque and angle and as a function of the recorded characteristics of the screw fastener.

14 Claims, 5 Drawing Sheets

F fDYNAMIC
FSETPOINT
FPLASTIC
FSETPOINT
PLASTIC RANGE
F(t)
fSTATIC
C
θ
θTIGHTENING
θTIGHTENING
θ(t)
C(t)
CTIGHTENING
CTIGHTENING f
f STATIC
f DYNAMIC

0
V

F
f DYNAMIC'
FSETPOINT
f DYNAMIC
ΔF(t)
FEARLY_STOP
A
f STATIC'
f STATIC
θ(t)
0
CTIGHTENING
C(t)

WRENCH WITH CONTROLLED TIGHTENING

FIELD OF THE INVENTION

The present invention relates to the field of controlled tightening and more particularly to manual wrenches such as torque wrenches including electrical or electronic measurement and processor means for informing the operator that a setpoint value has been reached.

BACKGROUND OF THE INVENTION

Controlling the tightening of screw fasteners can be implemented by various methods, in particular by measuring torque, angle, or tightening force. The method in most widespread use is tightening to a particular torque, either by using wrenches that release at that torque, or by using electronic wrenches. Tightening to a particular angle is in very widespread use in the automobile industry. This can be implemented with a manual wrench including means for measuring tightening angle. Tightening to a particular force has been used in the past only on very specific connections. For example, there exist wrenches that enable force tightening to be implemented, but only up to the elastic limit. Other known wrenches allow force tightening to be performed over a broader range, but they then require tightening to be performed in three successive stages (i.e. tightening up to an estimate of the intended tightening force, followed by loosening fully, and finally tightening back up to the calculated value), and that can be harmful to the integrity of the connection. In such applications, tightening is controlled by means of ultrasound measuring systems or hydraulic tensioners.

Tightening to a particular torque has the advantage of being simple to use. In contrast, it suffers from a major drawback: for a given tightening torque, the force on the screw fastener varies considerably, due to the large dispersion in coefficient of friction. This is illustrated diagrammatically in FIG. 9. In this figure, it can be seen that for a given setpoint torque, $C_{applied}$, the result of dispersion in the apparent coefficient of friction [$f_{min}$, $f_{max}$] is dispersion [$F_{min}$, $F_{max}$] in the traction force F on the screw fastener, and consequently dispersion in mechanical deformation.

When lubrication is based on Teflon® for example, as is used in cryogenic engines, experience shows that dispersion of the order of 300% on the coefficient of friction need to be taken into account when dimensioning screw connections. The magnitude of this dispersion lies behind numerous difficulties, and indeed impossibilities, in specifying a setpoint torque. When specifying and tightening to a particular torque, account needs to be taken of the extreme bounds on the range over which the coefficient of friction can vary: low coefficients of friction determine the mechanical strength of the assembly, whereas higher coefficients of friction are responsible for the quality of tightening in connections (gaskets sufficiently compressed, flanges sufficiently clamped, etc.). Such a situation is not satisfactory since it leads to connections being overdimensioned, which is harmful both in terms of mass, and concerning the mechanical behavior of the fastener over time (fatigue, loosening, . . . ).

Furthermore, it is necessary to take account of the mechanical deformation of the fastener that results from the traction force which is applied thereto. During a tightening operation, deformation initially occurs in the elastic range (i.e. reversibly), with deformation varying linearly with force, after which, if tightening is continued, deformation takes place in the plastic range (i.e. irreversibly), with deformation varying progressively more quickly with increasing stress, ending in rupture. Because of this behavior, when tightening to torque, the resulting traction forces are highly dispersed, and tightening should preferably be performed in the elastic deformation range of the fasteners, keeping well away from the elastic limit.

At present, tightening wrenches exist that enable either tightening torque to be controlled on its own, as described in U.S. Pat. No. 3,710,874, or else enabling tightening torque and angle of rotation to be controlled simultaneously so as to tighten the fastener by an amount that corresponds to the intended value for tightening toque and/or for angle of rotation. Such a device is described in particular in European patent application EP 1 022 097. Finally, there exist torque wrench devices with elaborate processor means enabling the accuracy of tightening to be increased. Such a device is described in particular in French patent application FR 2 780 785. Nevertheless, with that type of device, tightening can be controlled to reach a desired value only by making use of a specific tightening procedure that includes intermediate tightening and loosening steps.

To sum up, none of the known tightening devices constitutes a manual wrench enabling the instantaneous traction force exerted on the screw fastener to be determined, even though that is the parameter which determines the quality of tightening and how it will behave over time. Furthermore, devices do not exist that enable tightening that has been interrupted to be restarted directly and without risk.

OBJECT AND SUMMARY OF THE INVENTION

The present invention seeks to remedy the above-mentioned drawbacks and to provide a tightening wrench that avoids overdimensioning screw-fastened connections while enabling tightening to be performed in a single stage. The invention also seeks to provide a wrench that enables tightening that has been interrupted before reaching the desired value to be restarted without difficulty.

These objects are achieved by a tightening wrench comprising means for measuring the instantaneous applied torque, a head suitable for co-operating with a screw fastener, said head being fitted with means for measuring the instantaneous angle of rotation, and input means for storing characteristics of the screw fastener and a setpoint value for tightening, the wrench further comprising processor means for calculating the instantaneous traction force on the screw fastener as a function of the measured instantaneous values of torque and angle, and as a function of the stored characteristics of the screw fastener.

Thus, the instantaneous traction force is calculated directly during tightening, which makes it possible either to perform tightening that is directly controlled as a function of force, or else to make available the force value that was reached at the end of tightening. The quality of tightening can thus be controlled directly while tightening is taking place or it can be monitored at the end of tightening. This makes it possible to avoid overdimensioning connections.

The tightening wrench of the present invention also makes it possible to obtain and store data concerning the apparent coefficient of friction of the connection, and in particular how said coefficient varies as a function of speed and time and also the difference between the static and dynamic coefficients of friction. Access to this type of information relating to coefficients of friction makes it possible to detect possible anomalies, such as binding of the connection if the detected coefficient of friction is too large, for example.

The processor means calculate the instantaneous force in real time, thus enabling the screw fastener to be tightened in a single stage.

According to a characteristic of the invention, the processor means include software means for calculating the instantaneous coefficient of friction of the screw fastener or for restarting tightening that was interrupted prior to reaching the setpoint value.

According to another characteristic of the invention, the processor means include software means for detecting automatically, during a tightening operation, transition from the elastic range to the plastic range, and for calculating the instantaneous traction force on the fastener as a function of the result of detecting the elastic range or the plastic range.

In an embodiment of the invention, the means for measuring the instantaneous angle of rotation comprises a socket suitable for co-operating with the screw fastener, a bearing element made of a material having a low coefficient of friction so as to avoid disturbing measurement of tightening torque, and a spring interposed between the socket and the bearing element. The end of the bearing element for making contact with the screw fastener is provided with a material having a high coefficient of friction, such as rubber, so that the portion of the bearing element that is used for measuring the angle of rotation bears without slip on the non-turning portion of the screw fastener being tightened.

The wrench may also include storage means and a display device for storing and displaying information relating to tightening, such as the toque and angle of rotation values as measured during tightening, the traction force calculated during tightening, the static and dynamic coefficients of friction calculated during tightening, and also whether tightening is taking place in the elastic or the plastic range of deformation.

The setpoint value may correspond to a predetermined traction force, torque, or indeed angle of tightening. The device includes warning means operated by the processor means when the measured or calculated value reaches the setpoint value.

In the invention, the means for measuring the instantaneous applied torque, the input means, the processor means, and where appropriate the display means are disposed in a handle connected to the head of the wrench so as to enable an operator to perform tightening manually.

BRIEF DESCRIPTION OF THE DRAWINGS

Other characteristics and advantages of the invention appear from the following description of particular embodiments of the invention, given as non-limiting examples, and made with reference to the accompanying drawings, in which.

DETAILED DESCRIPTION OF AN EMBODIMENT

The method of controlling tightening implemented by the wrench of the present invention requires two types of measurement, measurement of the applied tightening torque and measurement of the tightening angle of rotation.

Torque is measured in conventional manner as in most commercially available torque wrenches, i.e. by measuring extension using signals from strain gauges.

Angle of rotation is measured electrically or electronically by using two concentric cylindrical surfaces of the connection. The measuring device used must generate a low coefficient of friction between the moving parts so as to avoid significantly disturbing the tightening torque taken into account for calculation purposes. Such a device may be constituted, for example, by a ball system or by tubes or bars made of materials having low coefficients of friction, such as Teflon®. This type of device for measuring angle of rotation is described in greater detail below in the present description.

Figure 1:
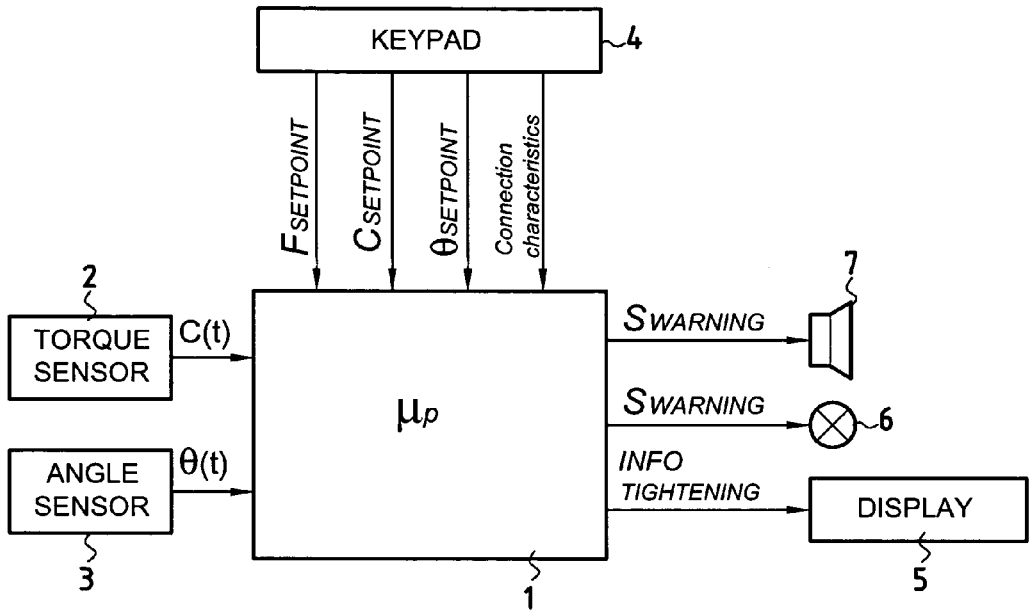
FIG. 1 is a block diagram of the control circuit for the tightening wrench in an embodiment of the invention.
Figure 9:
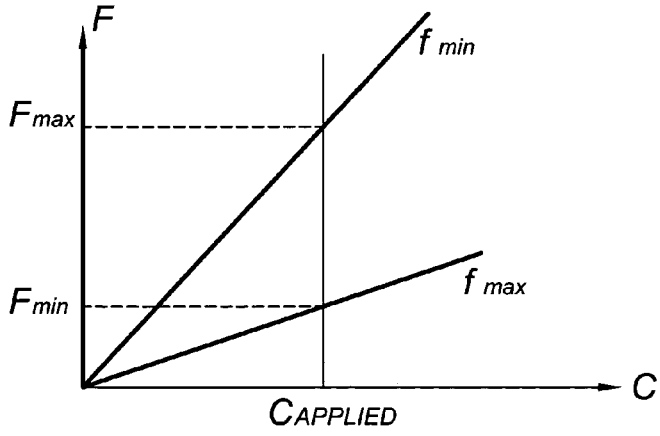
FIG. 9 is a graph showing traction F as a function of tightening torque C.

FIG. 1 is a block diagram showing the system implemented in the tightening wrench of the present invention. The wrench firstly comprises programmable processor means such as a microprocessor or calculator 1, for performing the calculations needed for controlling tightening in accordance with the invention. The microprocessor also serves to manage inputs and outputs of the system so as to enable an operator to control tightening. For this purpose, the microprocessor 1 receives as an input an instantaneous tightening torque value C(t) from a torque measuring device 2 and an instantaneous angle of rotation value θ(t) given by an angle measuring device 3. The microprocessor 1 is also connected to data input means such as a keypad 4 to enable the operator to specify setpoint values (i.e. force, torque, angle) that are to be reached and also physical parameters of the connection for tightening, which parameters are for use in performing calculations.

In order to warn the operator that the setpoint value has been reached, the system can include a sound generator 7 and/or an indicator light, such as a light-emitting diode (LED) 6, which are activated by a warning signal $S_{warning}$ delivered by the microprocessor. The system further comprises a display device 5 connected to the microprocessor for displaying the various data items to be input by the operator together with all of the data available at the end of tightening in digital or graphical form.

The method of the invention for controlling tightening implements mathematical processing performed by the microprocessor, as described below.

For simplification purposes, the description relates to the special case of tightening a nut-and-bolt fastener. The procedure is nevertheless generalizable to other types of screw connection such as screws, plugs, unions, or couplings, as specified below.

Figure 2:
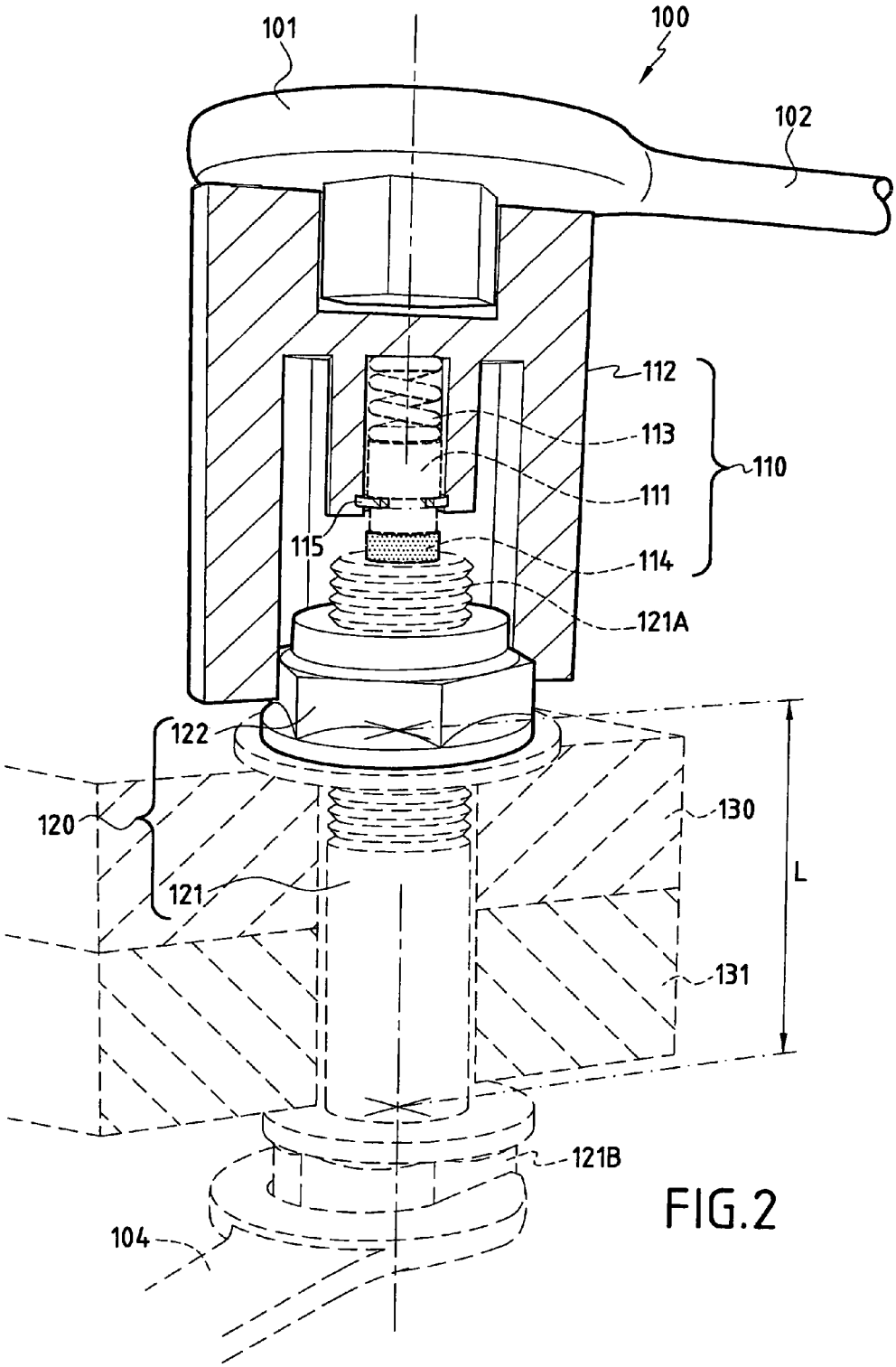
FIG. 2 is a perspective view in partial section of an embodiment of the wrench of the invention used for tightening a bolt type connection.

FIG. 2 shows an operation of assembling together two parts 130 and 131 by tightening a nut-and-bolt type connection 120 comprising a bolt 121 and a nut 122. The parts which turn during tightening are drawn in continuous lines whereas the parts that remain stationary are drawn in dashed lines. To tighten the connection 120, a tightening wrench 100 is used having a head 101 disposed at one end of a handle 102. The microprocessor 1, the keypad 4, and the display device 5 may be included in the handle 102 or they may be offset from the wrench, being connected thereto by a serial connection, for example.

The bolt 121 comprises a threaded portion 121A connected to a head 121B which is held in position by a second wrench 104. The parts 130 and 131 are then assembled together by tightening the nut 122 using the wrench 100. The wrench 100 includes measurement means (not shown) for measuring the applied tightening torque, for example strain gauges, which deliver an electrical signal proportional to the applied torque.

In this embodiment, angle of rotation is measured by a measurement device 110 which includes a tightening socket 112 for co-operating with the nut 122. The measurement device 110 measures differential rotation between the socket 112 and the bolt 121. For this purpose, the measurement device 110 comprises a bar 111 of Teflon® interposed between the bolt 121 and a spring 113 bearing against the socket 112. An anti-slip pellet 114 is interposed between the contact surface of the bolt and the bar 111 so that the portion of the socket used for measuring angle of rotation bears against the bolt to be tightened without turning. The spring serves to apply a normal force to the anti-slip pellet that is sufficient to prevent it from turning. The angle of rotation can be measured using various conventional techniques such as performing mechanical measurement (e.g. a spiral spring), electrical measurement (e.g. of the rheostat type), optical measurement, or magnetic measurement.

When a nut-and-bolt is stressed in the elastic deformation range, the instantaneous traction force F(t) can be calculated using following relationship (1):

$$F(t) = K \cdot x(t) = \frac{E \cdot A}{L} \cdot \frac{\theta(t) \cdot p}{360} \tag{1}$$

where:

x(t): instantaneous lengthening of the stretched fastener segment;

K: stiffness of the stretched fastener segment;

E: Young's modulus of the fastener;

A: right sectional area of the stretched fastener segment;

L: length of the stretched fastener segment;

p: pitch of the screw thread.

Values for E, A, L, and p are input by the operator via the keypad 4. The angle of rotation θ(t) is measured by the measurement device 3 of the wrench.

During tightening, the instantaneous coefficient of friction f(t) of the fastener is calculated using relationship (2) below:

$$C(t) = \int_{t'=0}^{t'=t} \left[ f(t') \cdot \frac{D_t}{2} + \frac{d_2}{2} \cdot \frac{K' \tan\alpha + f(t') \cdot \cos(\alpha)}{K' - f(t') \cdot \sin(\alpha)} \right] dF(t') \tag{2}$$

-continued $$\text{where: } \begin{cases} d_2 = d\frac{3}{8} \cdot \sqrt{3 \cdot p} \\ \tan\alpha = \frac{p}{\pi \cdot d_2} \\ K' = \frac{1}{\sqrt{1 + \tan^2\alpha + \tan^2\beta}} \end{cases}$$

and:

$D_t$: equivalent diameter of contact between the washer and the head of the bolt;

d: thread diameter;

α: helix angle of the fastener thread;

$d_2$: theoretical diameter of contact between threads (on the flanks of the thread);

β: half-angle of the thread of the fastener (30° for ISO M thread).

In the elastic range, it is possible to calculate f(t) since the value of the force F(t) is known, being deduced from above relationship (1), while the value of the torque C(t) is measured directly.

Figure 3:
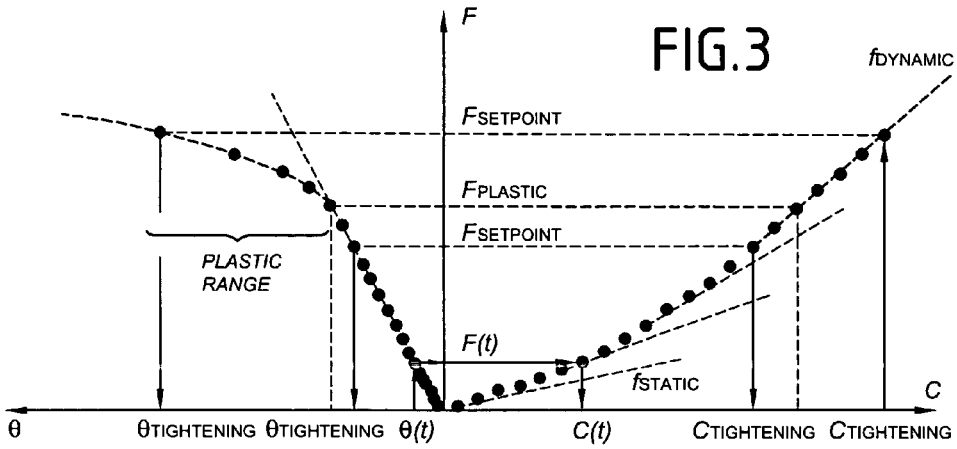
FIG. 3 is a graph showing how the traction force F(t) varies as a function of torque C(t) and angle of rotation θ(t) as measured in accordance with the invention.

The mechanical behavior during tightening is shown graphically in FIG. 3 where variation in traction force is plotted as a function of tightening torque C(t) (curve A) or of angle of rotation θ(t) (curve B).

When tightening to force, the procedure consists in inputting values for the following parameters before beginning tightening: $F_{setpoint}$, p, A, E, A, L, $D_t$, d, α, $d_2$, and β. Consequently, since the instantaneous force F(t) is calculated throughout the tightening operation, the resulting tightening force will be specifically the setpoint force input by the operator. Thus, the large dispersions that exist on tightening force when using prior art torque wrenches are eliminated. There is therefore no need to overdimension connections since the resulting tightening force is guaranteed in advance.

In addition, because torque and tightening angle are measured simultaneously together with the above-described mathematical processing, the instantaneous force can be calculated in real time, thus enabling tightening to force to be performed in a single stage.

FIG. 3 shows how to determine the instant at which the setpoint value $F_{setpoint}$ for the traction force is reached, depending on whether the mechanical connection remains in the elastic deformation range or whether on the contrary it extends into the plastic deformation range.

Providing the connection remains in the elastic deformation range, it suffices to interrupt tightening when the force F(t) as calculated in application of relationship (1) reaches the setpoint value $F_{setpoint}$.

On the contrary, if the connection involves plastic deformation, the processor means detect in real time the beginning of plastic deformation from the decrease in the gradient of curve B. From this instant, F(t) ceases to be determined from relationship (1) since it is no longer valid, but is calculated as described below. As can be seen from FIG. 4, which shows the theoretical appearance of coefficient of friction between two surfaces in contact as a function of their relative speed V, when the connection begins to deform plastically, the coefficient of friction F(t) tends rapidly towards a constant value $f_{dynamic}$ This value can be calculated approximately by means of relationship (2) applied to the elastic limit, where relationship (1) is still valid for determining the instantaneous traction force F(t). It then suffices to use relationship (2) reduced under these circumstances to a simple linear equation, using the constant value found for $f_{dynamic}$ in order to determine F(t) and stop tightening when the setpoint value $F_{setpoint}$ for the traction force is reached.

Thus, tightening to force can be performed both in the elastic range and in the plastic range, and this can be done in a single stage. The processor means are programmed to act in real time to detect the transition from the elastic range to the plastic range and accordingly to modify how force is calculated as described above.

After tightening has been performed, a certain amount of information is available, as specified in Table 1 below. This information is displayed on the display device 5.

TABLE 1

| | |
|---|---|
| Final characteristics of tightening | $(C, \theta, F)_{tightening}$ |
| Characterization of friction | $f_{static}$ and $f_{dynamic}$ |
| Plastic deformation of fastener | tightening in the elastic or plastic deformation range when tightening enters the plastic deformation range: $(C, \theta, F)_{plastic}$ |
| Traceability of tightening | C(t), θ(t), F(t), f(t) |

Figure 4:
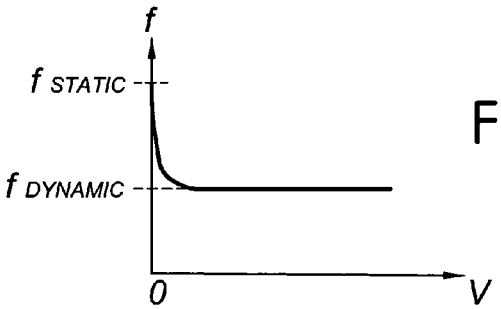
FIG. 4 is a graph showing the theoretical appearance of the coefficient of friction f between two contacting surfaces as a function of their relative speed V.

The tightening wrench of the invention also presents the advantage of being able to restart tightening that was interrupted prior to reaching the setpoint value, unlike conventional tightening to torque (e.g. using a wrench that trips at the set torque). When tightening to torque with a prior art torque wrench, if tightening is stopped before it has been completed, it is no longer possible to reach the intended force since, as shown in FIG. 4, when it is desired to restart tightening, the coefficient of friction is considerably higher than it was prior to the interruption. It is therefore necessary to apply tightening torque greater than that specified in order to enable the force in the threaded element to start increasing again. With the tightening wrench of the invention, this situation is detected automatically and managed by means of the instantaneous measurements performed on torque C(t) and angle of rotation θ(t), and also on the basis of the parameters, and in particular the coefficient of friction as calculated using equations (1) and (2).

Figure 5:
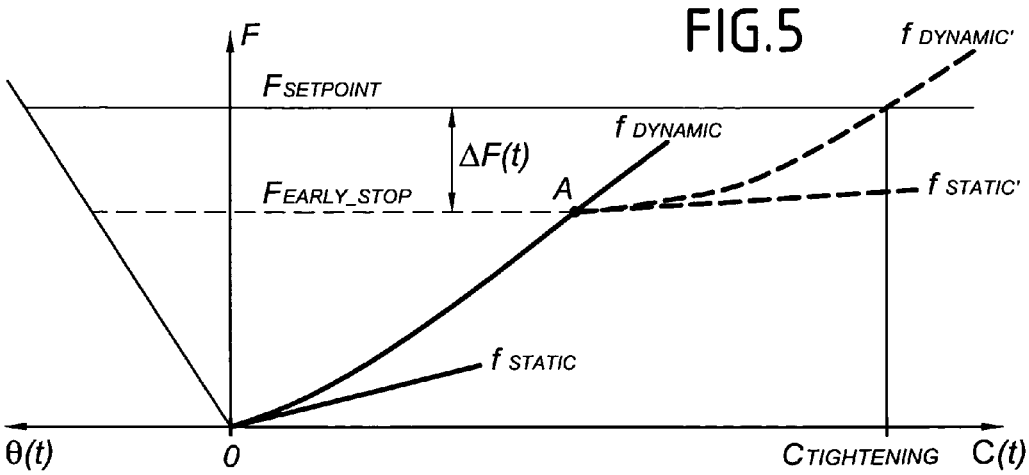
FIG. 5 is a graph showing how traction force F(t) varies as a function of measured torque C(t) and angle of rotation θ(t) in accordance with the invention in the event of tightening being interrupted.

FIG. 5 shows an example of tightening that has been interrupted and that has subsequently been restarted using a wrench of the invention. In the figure, point A represents the moment when tightening was interrupted prior to reaching the setpoint value, i.e. at a value $F_{earlystop}<F_{setpoint}$. The processor means of the wrench detect that tightening has been interrupted since $F_{earlystop}<F_{setpoint}$, and there is no further change in the angle of rotation θ(t). The intermediate value $F_{earlystop}$ is stored. At this instant, the socket can be withdrawn, and any kind of inspection operations can be performed on the equipment. When tightening is restarted, the processor means detect that it has started from the information given by the torque C(t) which again begins to vary. The processor means detect the moment when the angle of rotation θ(t) begins to grow again, and as soon as this happens, they calculate the coefficient of friction f(t) which varies in the manner shown by dashed lines $f_{static}'$ and $f_{dynamic}'$. Thus, tightening is terminated when the measured force value ΔF(t) added to the value $F_{earlystop}$ as measured when tightening was interrupted, reaches the setpoint value, i.e. when:

$$F_{earlystop}+\Delta F(t)=F_{setpoint}$$

The curves of FIG. 5 show that in the event of tightening being interrupted, it is necessary to deliver higher torque than when tightening takes place continuously. The above-described procedure enables this physical reality to be taken into account, i.e. the fact that the coefficient of friction can be different after tightening has been interrupted (adaptation of surface states).

Figure 6:
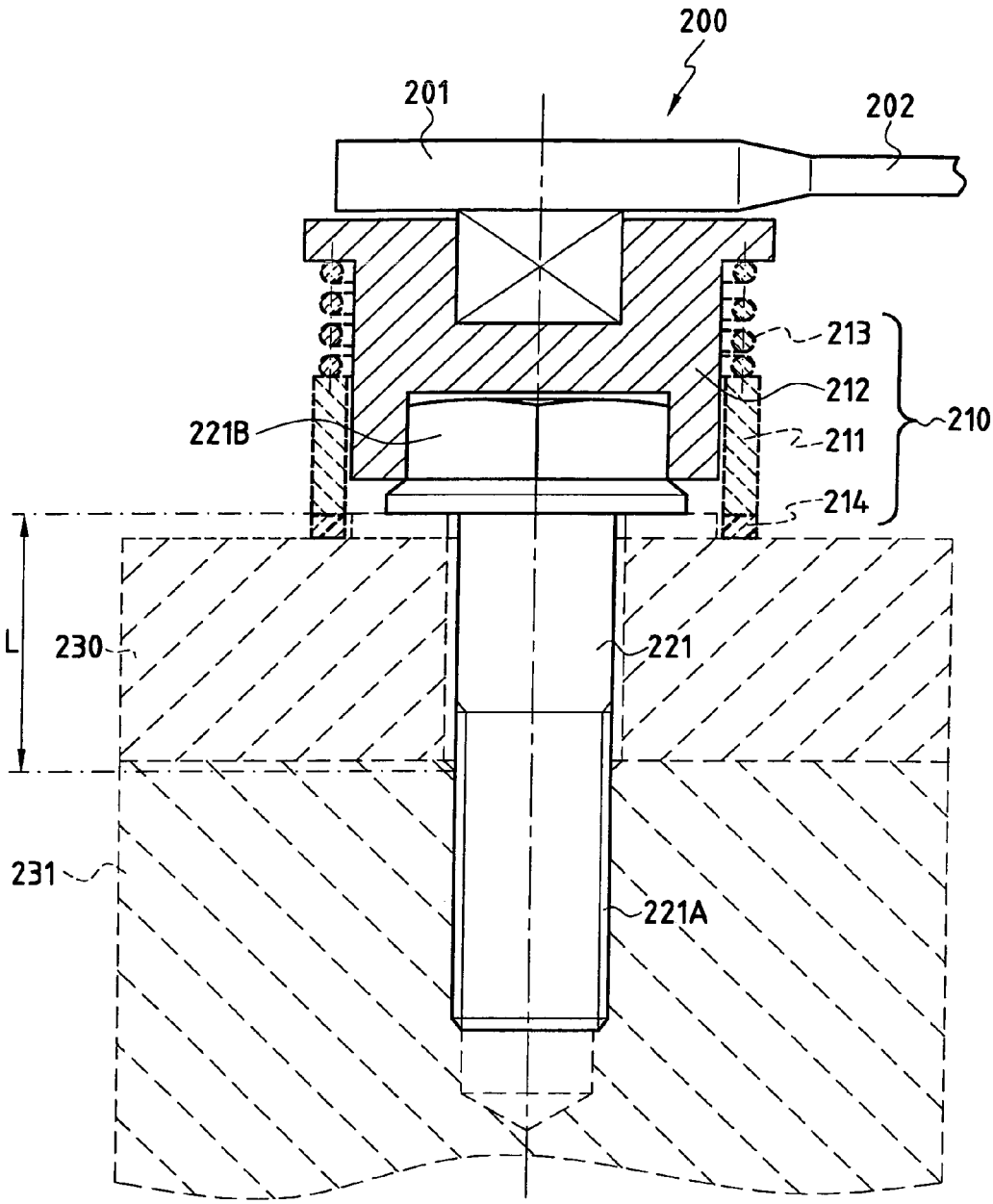
FIG. 6 is a section view of an embodiment of the wrench of the invention used for tightening a screw.
Figure 7:
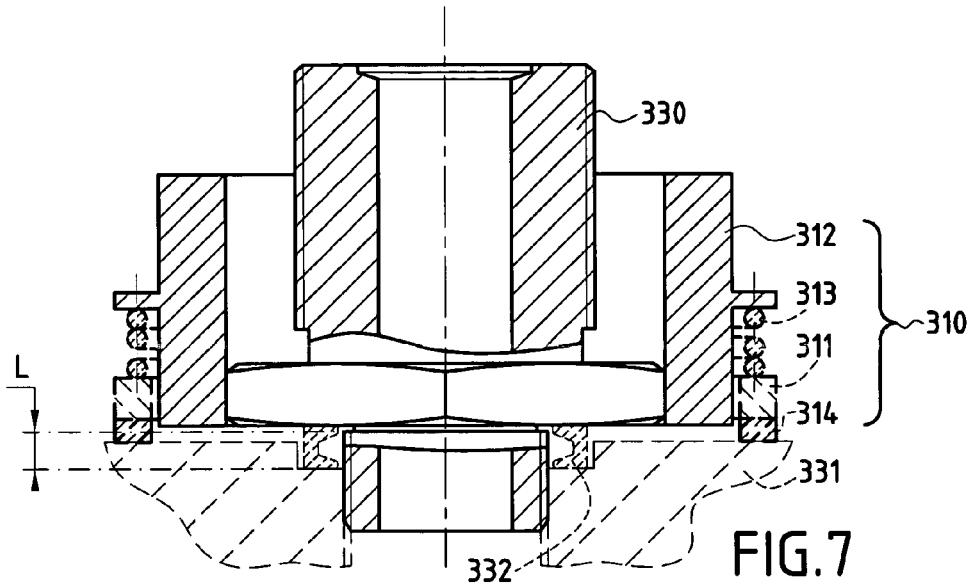
FIG. 7 is a fragmentary section of an embodiment of the wrench of the invention used for tightening a union type connection.
Figure 8:
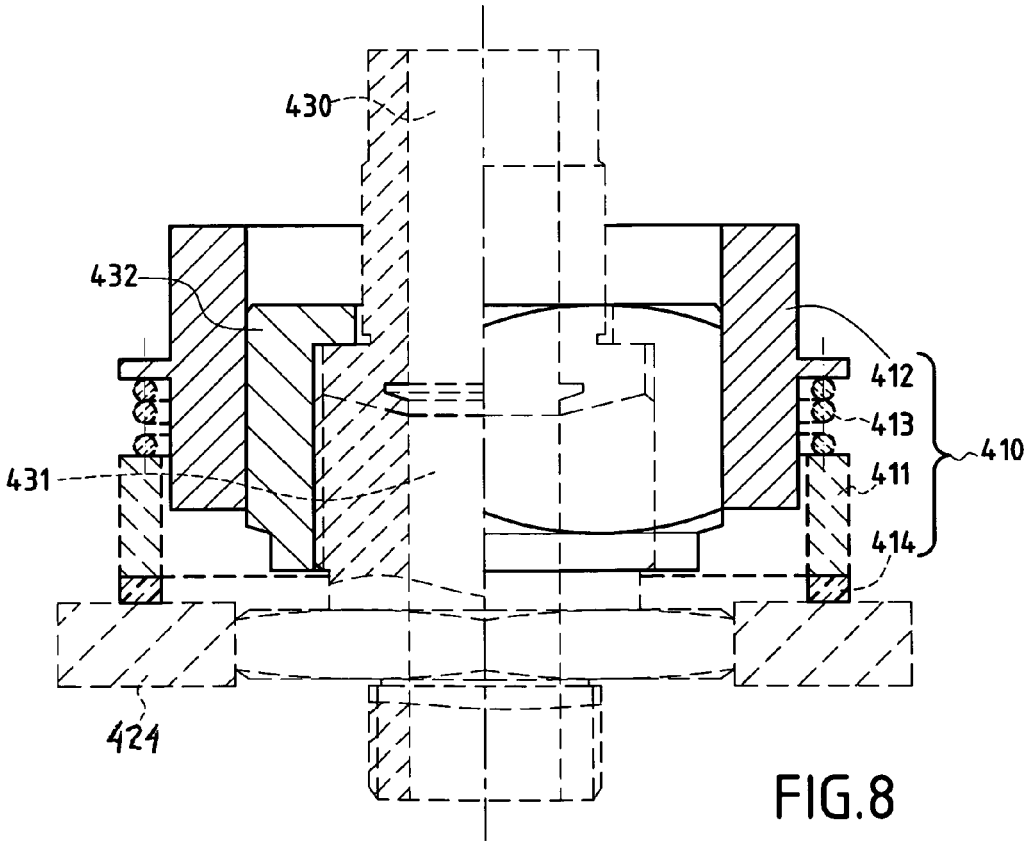
FIG. 8 is a fragmentary section view of an embodiment of the wrench of the invention used for tightening a coupling type connection.

The use of the tightening wrench of the present invention is not limited to tightening nuts and bolts. For example, the wrench can be used for tightening screws, plugs, unions, or couplings, as shown in FIGS. 6 to 8. As in FIG. 2, parts which turn during tightening are drawn in continuous lines, whereas parts that remain stationary are drawn in dashed lines.

FIG. 6 shows the configuration used for tightening a screw or a plug 221 in order to assemble a first part 230 with a second part 231 that is tapped in order to receive the threaded portion 221A of the screw. Tightening is performed with a wrench 200 similar to the wrench 100 of FIG. 2. Angle of rotation is measured by a measuring device 210 which includes a tightening socket 212 co-operating with the head 221B of the screw. The measuring device 210 measures differential rotation between the socket 212 and the first part 230 by means of a spring 213 placed around the outer periphery of the socket, a tube 211 made of Teflon® together with an anti-slip ring 214 being interposed between the spring 213 and the top surface of the first part 230.

FIG. 7 shows a union 330 being tightened onto an element 331 into which it is to be implanted with a V-type sealing gasket 332 being interposed. In this configuration, the device 310 for measuring angle of rotation comprises a tightening socket 312 with a spring 313, a Teflon® tube 311, and optionally an anti-slip ring 314 for measuring differential rotation between the socket and the implantation element 331.

Finally FIG. 8 shows the tightening of a conical coupling comprising two tube pieces 430 and 431 assembled together by a nut ring 432. In this example of an application for the wrench of the invention, the angle-measuring device 410 is still formed by a tightening socket 412, a spring 413, a tube 411, and an anti-slip ring 414, and it measures differential rotation between the socket and the second wrench 424 used to keep the tube piece 431 in position.

The tightening operation described above in the particular circumstances of tightening a nut and bolt to a force can easily be generalized to the other configurations described with reference to FIGS. 6 to 8. To do this, it suffices to adapt the length parameter L to each of these configurations. As shown in FIGS. 2, 6, and 7, the parameter L represents the length of the portion of the threaded element which is not in screw/nut co-operation, with the nut possibly being one of the parts as in FIG. 6.

The above-described dispositions for the various possible tightening configurations make use of systems for measuring angle of rotation by using springs. Other means are possible, such as optical measurements replacing both the spring and the bearing element.

The tightening wrench and its measurement and control means can also be used in other tightening methods such as tightening to torque, to angle, to torque and then to angle (or vice versa), or to torque while monitoring angle (or vice versa).

When tightening to torque, tightening is performed in the same manner as with a conventional electronic wrench. It suffices to input the desired torque $C_{setpoint}$ (FIG. 1) into the wrench and then to tighten until the audible or luminous signal announces that the set torque has been reached. The specific instrumentation of the socket is not used in this type of tightening. When tightening to angle, tightening is performed using the same principle as when tightening to torque. It suffices to input the desired tightening angle $\theta_{setpoint}$ into the wrench and then to tighten until an audible and/or luminous signal announces that the setpoint tightening angle has been obtained.

When tightening to torque and then to angle (or vice versa), it is necessary to apply the above procedures in succession for tightening to torque and then for tightening to angle (or vice versa). When tightening to torque while monitoring angle (or vice versa), this novel type of wrench enables the angle of rotation of the threaded element to be verified after applying the specified tightening torque. The converse is also possible: tightening to angle up to a set value, and then monitoring the torque. Under all circumstances, the value of the traction force F that results therefrom is available at the end of tightening, which enables the quality of screw tightening to be monitored.

Whatever the use made of this new type of wrench, the coefficient of friction determined during tightening is provided and that constitutes additional information concerning the quality of the tightening that has been performed.

What is claimed is:

1. A wrench comprising means for measuring an instantaneous applied torque, a head suitable for co-operating with a screw fastener, said head being fitted with means for measuring an instantaneous angle of rotation, input means for recording characteristics of the screw fastener and a setpoint value for tightening thereof, and processor means for calculating an instantaneous traction force on the screw fastener as a function of measured instantaneous values of torque and angle and as a function of stored characteristics of the screw fastener, wherein the processor means further comprise software means for acting during a tightening operation to detect automatically a transition from an elastic deformation range to a plastic deformation range and to calculate the instantaneous traction force on the screw fastener as a function of the plastic deformation range.

2. A wrench according to claim 1, wherein the processor means calculate the instantaneous traction force in real time so as to enable the screw fastener to be tightened in a single stage.

3. A wrench according to claim 1, wherein the processor means further include software means for calculating an instantaneous coefficient of friction of the screw fastener being tightened, the instantaneous coefficient of friction C(t) being calculated by solving the following integral:

$$C(t) = \int_{t'=0}^{t'=t} \left[ f(t') \cdot \frac{D_t}{2} + \frac{d_2}{2} \cdot \frac{K' \tan\alpha + f(t') \cdot \cos(\alpha)}{K' - f(t') \cdot \sin(\alpha)} \right] dF(t') \quad (2)$$

$$\text{where: } \begin{cases} d_2 = d\frac{3}{8} \cdot \sqrt{3 \cdot p} \\ \tan\alpha = \frac{p}{\pi \cdot d_2} \\ K' = \frac{1}{\sqrt{1 + \tan^2\alpha + \tan^2\beta}} \end{cases}$$

and:

$D_t$: equivalent diameter of contact between a washer and a head of a bolt;

d: thread diameter;

α: helix angle of a thread of the screw fastener;

$d_2$: theoretical diameter of contact between threads (on the flanks of the thread);

β: half-angle of the thread of the screw fastener (30° for ISO M thread).

4. A wrench according to claim 3, including means for detecting anomalies such as a connection binding as a function of the instantaneous coefficient of friction.

5. A wrench according to claim 1, wherein the means for measuring the instantaneous angle of rotation comprise a socket suitable for co-operating with the screw fastener, a bearing element made of a material having a low coefficient of friction, and a spring interposed between the socket and the bearing element, the end of the bearing element for coming into contact with the screw fastener being provided with an element having a high coefficient of friction.

6. A wrench according to claim 1, wherein the processor means include software means for restarting tightening that has been interrupted prior to reaching the setpoint value.

7. A wrench according to claim 1, further including storage means and a display device for storing and displaying information relating to tightening and available at the end of the tightening operation.

8. A wrench according to claim 7, wherein the information relating to tightening comprises in particular the torque C(t) and angle of rotation θ(t) values measured during tightening, the traction force F(t) calculated during tightening, the static and dynamic coefficients of friction ($f_{static}$, $f_{dynamic}$) calculated during tightening, and also the deformation range, with the corresponding plastic deformation information $(C, \theta, F)_{plastic}$ in the event of the screw fastener being subjected to plastic deformation.

9. A wrench according to claim 7, wherein the information relating to tightening includes how the calculated coefficient of friction varied as a function of speed and of time.

10. A wrench according to claim 7, wherein the information relating to tightening includes the calculated difference between the static and dynamic coefficients of friction.

11. A wrench according to claim 1, wherein the setpoint value corresponds to a predetermined traction force, and wherein the wrench includes warning means operated by the processor means once the calculated force reaches the setpoint value.

12. A wrench according to claim 1, wherein the setpoint value corresponds to a predetermined tightening torque, and wherein the wrench includes warning means operated by the processor means when the measured torque value reaches the setpoint value.

13. A wrench according to claim 1, wherein the setpoint value corresponds to a predetermined tightening angle, and wherein the wrench includes warning means operated by the processor means when the measured value for the angle of rotation reaches the setpoint value.

14. A wrench according to claim 1, wherein said wrench is a manual wrench, the means for measuring instantaneous applied torque, the input means, and the processor means being included in a handle to enable an operator to perform tightening manually.

* * * * *

UNITED STATES PATENT AND TRADEMARK OFFICE

CERTIFICATE OF CORRECTION

PATENT NO. : 7,036,407 B2
APPLICATION NO. : 10/806003
DATED : May 2, 2006
INVENTOR(S) : Alain Pyre et al.

It is certified that error appears in the above-identified patent and that said Letters Patent is hereby corrected as shown below:

Column 1, lines 3-4, following the title, insert the following sentence:
--This application claims priority to a French application No. 03 03695 filed March 26, 2003.--

Column 6, line 31, "$F_{setpont}$, p, A, E, A, L," should read --$F_{setpont}$, p, E, A, L,--

Signed and Sealed this

Fourth Day of December, 2007

JON W. DUDAS
*Director of the United States Patent and Trademark Office*

UNITED STATES PATENT AND TRADEMARK OFFICE

CERTIFICATE OF CORRECTION

PATENT NO. : 7,036,407 B2
APPLICATION NO. : 10/806003
DATED : May 2, 2006
INVENTOR(S) : Alain Pyre et al.

It is certified that error appears in the above-identified patent and that said Letters Patent is hereby corrected as shown below:

Column 1, lines 3-4 following the title, insert the following sentence:
--This application claims priority to a French application No. 03 03695 filed March 26, 2003.--

Column 6, line 31, "$F_{setpont}$, p, A, E, A, L," should read --$F_{setpont}$, p, E, A, L,--

Signed and Sealed this

Eighteenth Day of December, 2007

JON W. DUDAS
*Director of the United States Patent and Trademark Office*